US008949114B2

(12) United States Patent
Grancharov et al.

(10) Patent No.: US 8,949,114 B2
(45) Date of Patent: Feb. 3, 2015

(54) METHOD AND ARRANGEMENT FOR ESTIMATING THE QUALITY DEGRADATION OF A PROCESSED SIGNAL

(75) Inventors: Volodya Grancharov, Solna (SE); Anders Ekman, Stockholm (SE)

(73) Assignee: Optis Wireless Technology, LLC, Plano, TX (US)

( * ) Notice: Subject to any disclaimer, the term of this patent is extended or adjusted under 35 U.S.C. 154(b) by 461 days.

(21) Appl. No.: 13/321,937

(22) PCT Filed: Jun. 4, 2009

(86) PCT No.: PCT/SE2009/050668

§ 371 (c)(1), (2), (4) Date: Nov. 22, 2011

(87) PCT Pub. No.: WO2010/140940

PCT Pub. Date: Dec. 9, 2010

(65) Prior Publication Data

US 2012/0069888 A1 Mar. 22, 2012

(51) Int. Cl.

| | |
|---|---|
| ***G10L 19/00*** | (2013.01) |
| ***G10L 21/02*** | (2013.01) |
| ***G10L 25/69*** | (2013.01) |

(52) U.S. Cl.

CPC ..... *G10L 25/69* (2013.01)
USPC ..... 704/200.1; 704/226

(58) Field of Classification Search

CPC ..... G10L 25/69
USPC ..... 704/200.1, 200, 226–228
See application file for complete search history.

(56) References Cited

U.S. PATENT DOCUMENTS 5,657,420 A 8/1997 Jacobs et al.
6,330,428 B1 * 12/2001 Lewis et al. ..... 455/67.11

(Continued)

FOREIGN PATENT DOCUMENTS

EP 1206104 A1 5/2002
EP 1343145 A1 9/2003

(Continued)

OTHER PUBLICATIONS

Ekman, L et al., "Double-Ended Quality Assessment System for Super-Wideband Speech," IEEE Transactions on Audio, Speech, and Language Processing, vol. 19, No. 3, pp. 558-569, Mar. 2011, New York, NY.

(Continued)

*Primary Examiner* — Angela A Armstrong
(74) *Attorney, Agent, or Firm* — Vincent J. Allen; James H. Ortega; Carstens & Cahoon, LLP

(57) ABSTRACT

An objective quality assessment method for obtaining an improved estimate of a perceptual quality degradation of a processed signal, and an arrangement for executing such a method, is provided, which is executed on a processed signal and an associate reference signal. Both signals are split up into associated frame-pairs after which either all or selected frame-pairs are processed further, by creating a reference residual signal and a processed residual signal for each frame-pair, calculating separate ratios of p-norms on both residual signals, and by calculating and storing a per-frame quality estimate on the basis of the ratios of p-norms for each selected frame-pair. An objective per-signal quality estimate that is proportional to the perceptual quality degradation is then provided by aggregating the calculated per-frame-pair quality estimates.

19 Claims, 3 Drawing Sheets

(56) References Cited

U.S. PATENT DOCUMENTS

| | | | | |
|---|---|---|---|---|
| 7,844,450 | B2 * | 11/2010 | Leonhard | 704/200 |
| 7,856,355 | B2 * | 12/2010 | Kim | 704/228 |
| 2005/0143974 | A1 | 6/2005 | Joly | |
| 2006/0200346 | A1 * | 9/2006 | Chan et al. | 704/233 |
| 2007/0286351 | A1 | 12/2007 | Ethier et al. | |
| 2012/0116759 | A1 * | 5/2012 | Folkesson et al. | 704/226 |

FOREIGN PATENT DOCUMENTS

| | | | |
|---|---|---|---|
| WO | 0152600 | A1 | 7/2001 |
| WO | 03076889 | A1 | 9/2003 |
| WO | 2007089189 | A1 | 8/2007 |

OTHER PUBLICATIONS

Grancharov, V. et al. "Low-Complexity, Nonintrusive Speech Quality Assessment", IEEE Transactions on Audio Speech and Language Processing, vol. 14, No. 6, Nov. 2006.

* cited by examiner

METHOD AND ARRANGEMENT FOR ESTIMATING THE QUALITY DEGRADATION OF A PROCESSED SIGNAL

TECHNICAL FIELD

The present invention relates to a method and arrangement for estimating a perceptual quality degradation of a processed signal. In particular, a method is suggested that is applicable for estimating perceptual quality degradation caused from the use of bandwidth extension and noise-fill schemes, in association with speech or audio encoding.

BACKGROUND

With the emergence of distribution of speech and audio content via communication networks, an efficient use of the available bandwidth is an important issue for the network operators, while, at the same time, the quality perceived by the end-user has to remain high. This raises a demand for efficient processing schemes at codec's, both of the transmitting and receiving entities.

In order to obtain efficient transmission of speech and audio over a communication network, bandwidth extension (BWE) and noise-fill schemes are commonly used in speech and audio codec's, and, due to increasing bandwidth requirements, use of such schemes will be even more important in the future. A main issue with using the BWE concept is to quantize and transmit only low-frequency (LF) regions of a signal on the transmitting (encoder) side, to transmit these regions to a receiver, and then to reconstruct high-frequency (HF) regions at the receiver side (decoder).

A process of HF reconstruction can be based on the signal residual of the LF signal, i.e. the signal with the spectrum envelope removed, together with some additional transmitted information, such as e.g. a set of energy gains, or a set of linear-prediction coefficients and a global energy gain, which represents the HF spectrum envelope. As a result, BWE causes a special type of degradation of the signal that is localized in the residual of the HF bands of the signal. Similar artifacts are also caused by the noise-fill schemes, when used in speech or audio coding. A basic concept of noise-filling is that some low-energy LF bands are not encoded at the encoder of the transmitter. At the decoder of the receiver, the signal residual in these bands is then replaced with White Gaussian Noise (WGN), or reconstructed from neighboring LF bands.

A spectrum envelope and a compressed residual for a speech frame can be exemplified with the illustration of FIG. 1.

For a signal having a spectrum envelope 100, a LF residual 101 and a HF residual 102, the spectrum envelope 100 and the LF residual 101 may typically be quantized and compressed in the encoder, before it is transmitted to a receiver/decoder, where the HF residual 102 may be reconstructed by translating or flipping the LF residual 101, according to any prior art reconstruction procedure.

A typical configuration for estimating a quality degradation originating from a signal process of a codec can be described as follows, with reference to the schematic illustration of FIG. 2, where an apparatus configured to estimate a quality measure, here referred to as a quality assessment device 200, is receiving a signal, in the present context typically a speech or audio signal, that has been transmitted from a signal source 201, via a communication network 202. This signal, which is an encoded signal that has been transmitted via communication network 202, and decoded before it is provided to the quality assessment device 200, is typically referred to as the processed signal 203. The quality assessment device 200, also have access to a reference signal 204, which is representing the unprocessed signal of signal source 201.

On the basis of both the reference signal 204 and the processed signal 203, the quality assessment device 200 may estimate speech or audio quality of a signal that has been affected by coding distortion, on the basis of some algorithm that is suitable for such a measure. Such algorithms are known e.g. from ITU-T Rec. P.862, "Perceptual evaluation of speech quality (PESQ), an objective method for end-to-end speech quality assessment in narrow-band telephone networks and speech codec's", 2001-02; ITU-T Rec. P.862.2, "Wideband extension to recommendation P.862 for the assessment of wideband telephone networks and speech codec's", 2005-11, and from ITU-R Rec. BS.1387-1, "Method for objective measurements of perceived audio quality", 2001.

One problem with existing solutions, such as any of the ones mentioned above, is that, due to the so called BWE effects, they are quite insensitive to distortions introduced by the codec, to the signal residual of the higher bands of the processed signal, during an encoding process. At the same time these distortions are audible and, thus, normally they lead to overall quality degradation. One reason why BWE distortions are not captured by the state-of-the-art quality measures lies in the specific of the perceptual transform used during these measures. This is particularly relevant in the well known frequency transform to the Bark or Mel scale, where the higher frequency bands have a large bandwidth, and, thus, masks any effects of the signal residual that may reside inside these bands.

Consequently, despite the fact that BWE is widely used in today's codec's, and that this type of schemes most likely will be even more important for the future codec's, there is at present no clear methods known on how to obtain a representative measure on the degradation, caused from using a BWE or noise-fill-scheme. The above statement is applicable even to the best known algorithms for speech/audio quality estimation of coding distortions.

SUMMARY

It is an object of the present invention to address the deficiencies of known methods and arrangements mentioned above. More specifically, it is an object of the present invention to provide a quality measure that gives a reliable measure of a quality deterioration of a signal.

This object, as well as other related ones, can be obtained by providing a method and an arrangement, according to the independent claims attached below.

According to one aspect, a method for obtaining an objective quality assessment for estimating a perceptual quality degradation of a processed signal is obtained.

The suggested method involves an improved method to be executed on a processed signal and a reference signal, where both signals are first split into associated frame-pairs. Out of the split frame-pairs first frame-pair to be further processed according to the suggested method are then selected, according to applied criteria. Such criteria may include all frame-pairs, or selection of frame-pairs after a comparison with a pre-defined threshold.

In a next step a reference residual signal and a processed residual signal are created for a selected frame-pair, and in a further step separate ratios of p-norms on both residual signals are calculated for the selected frame-pair.

On the basis of the ratios of p-norms obtained for the selected frame-pair, a per-frame quality estimate is then calculated and stored. By iteratively selecting additional frame-pairs and repeating the previous processing steps for each selected frame-pair, an array of per-frame quality estimates will be obtained. This array can then be used as an input for providing an objective per-signal quality estimate that is proportional to the perceptual quality degradation by aggregating the calculated per-frame-pair quality estimates.

The suggested method may be used e.g. for obtaining a quality estimate of a signal in association with using a bandwidth extension scheme or noise-fill scheme during encoding of the signal.

The estimating process described above may be repeated, such that objective per-signal quality estimates are repeatedly provided and stored. On the basis of this input data one or more parameters of a network node that is used for distribution of the processed signal may be iteratively adjusted.

Calculation of the respective ratios of p-norms, may be described as comprising the step of calculating a ratio of p-norms, $L_r(n)$ for the reference signal, and a ratio of p-norms, $L_p(n)$ for the processed signal for frame-pair n, wherein:

$$L_r(n) = \frac{\left\{\frac{1}{K}\sum_{k=1}^{K}|e_r(k)|^S\right\}^{\frac{1}{S}}}{\left\{\frac{1}{K}\sum_{k=1}^{K}|e_r(k)|^Q\right\}^{\frac{1}{Q}}}$$

and $$L_P(n) = \frac{\left\{\frac{1}{K}\sum_{k=1}^{K}|e_p(k)|^S\right\}^{\frac{1}{S}}}{\left\{\frac{1}{K}\sum_{k=1}^{K}|e_p(k)|^Q\right\}^{\frac{1}{Q}}}$$

where $e_r(k)$ is the residual reference signal for sample k, $e_p(k)$ is the processed residual signal for sample k, K is the total number of samples of frame-pair n, while S and are optimization parameters where S<Q.

A per-frame-pair quality estimate, D(n), for a frame, n, may be defined as:

$$D(n) = \frac{L_r(n) - L_p(n)}{L_r(n) + L_p(n)}$$

while a per-signal quality estimate, $D_{res}$, may be defined as:

$$D_{res} = \sqrt{\frac{1}{N}\sum_{n=1}^{N} D(n)^2}$$

where N is the total number of selected frame-pairs.

According to another aspect, an arrangement that is configured for executing the suggested estimation method is also provided. Such an arrangement may comprise an estimating unit that is configured to split the received signals into associated frame-pairs and to iteratively select frame-pairs for successive further processing according to the method described above.

Such an arrangement is typically further configured to repeatedly provide objective per-signal quality estimates to a receiving device, and may be configured to select all frame-pairs associated with a signal to be further processed, or to selectively determine which frame-pairs to be further processed on the basis of a comparison of frame-pairs to a predefined threshold.

The arrangement may also be configured to combine the obtained output data, i.e. the aggregated, calculated per-frame-pair quality estimates, with at least one additional per-signal quality estimate, that has been derived by way of executing a measure, according to one or more prior art methods.

According to one alternative embodiment, the suggested arrangement may be configured to provide the derived quality estimates to a unit, e.g. a network optimizing unit, which is configured to execute configurations and/or re-configurations of at least one network node on the basis of an objective per-signal quality estimate According to another alternative embodiment, the arrangement may instead be configured to provide its output data to a unit, e.g. a detecting unit, which is configured to detect a failure of a network node on the basis of an objective per-signal quality estimate, obtained from an arrangement according to any of claims 10-17.

As can be seen from tests that are executed on the basis of the suggested method and an the basis of a number of alternative methods, that are frequently used for measures of the kind described in this document, the suggested method provides measures that give a reliable indication of the quality deterioration, that may otherwise be difficult to estimate.

Further features of the present invention and its benefits will be explained in more detail in the detailed description below.

BRIEF DESCRIPTION OF THE DRAWINGS

The present invention will be described in more detail by means of exemplary embodiments and with reference to the accompanying drawings, in which.

DETAILED DESCRIPTION

As already stated above, signal processing that is commonly used in codec's of transmitters today for the purpose of obtaining a more efficient use of bandwidth often come with the drawback of a quality degradation that is distinguishable by the end-user, but hard to obtain a perceptual measure for.

It is therefore a desire to come up with a method and an arrangement that can provide such a measure. On the basis of such a measure, adjustments can be made to one or more parameters of the used communication system, such that the caused quality degradation can be compensated for.

Figure 1:
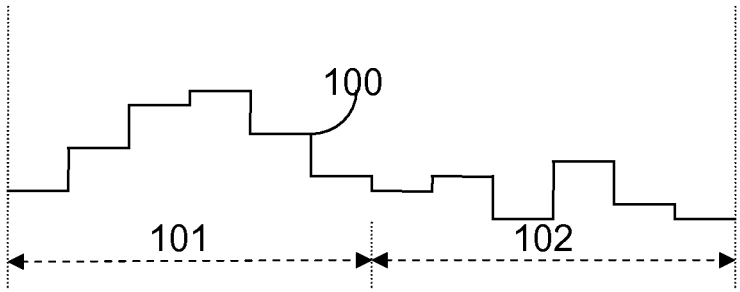
Figure 1 (PRIOR ART )
FIG. 1 is a schematic representation of a spectrum envelope and compressed residuals for a speech frame, according to the prior art.
Figure 2:
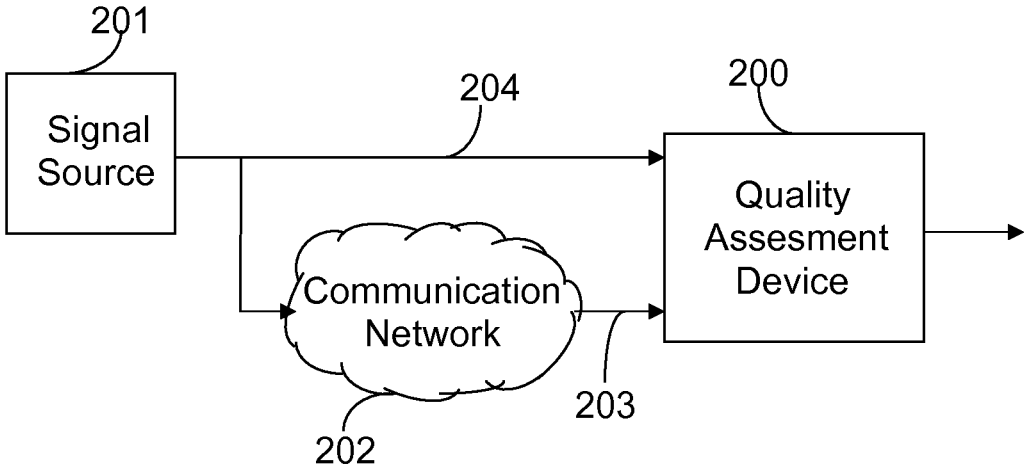
Figure 2 (PRIOR ART)
FIG. 2 is a schematic illustration of a quality assessment arrangement of a communication network, according to the prior art.
Figure 3:
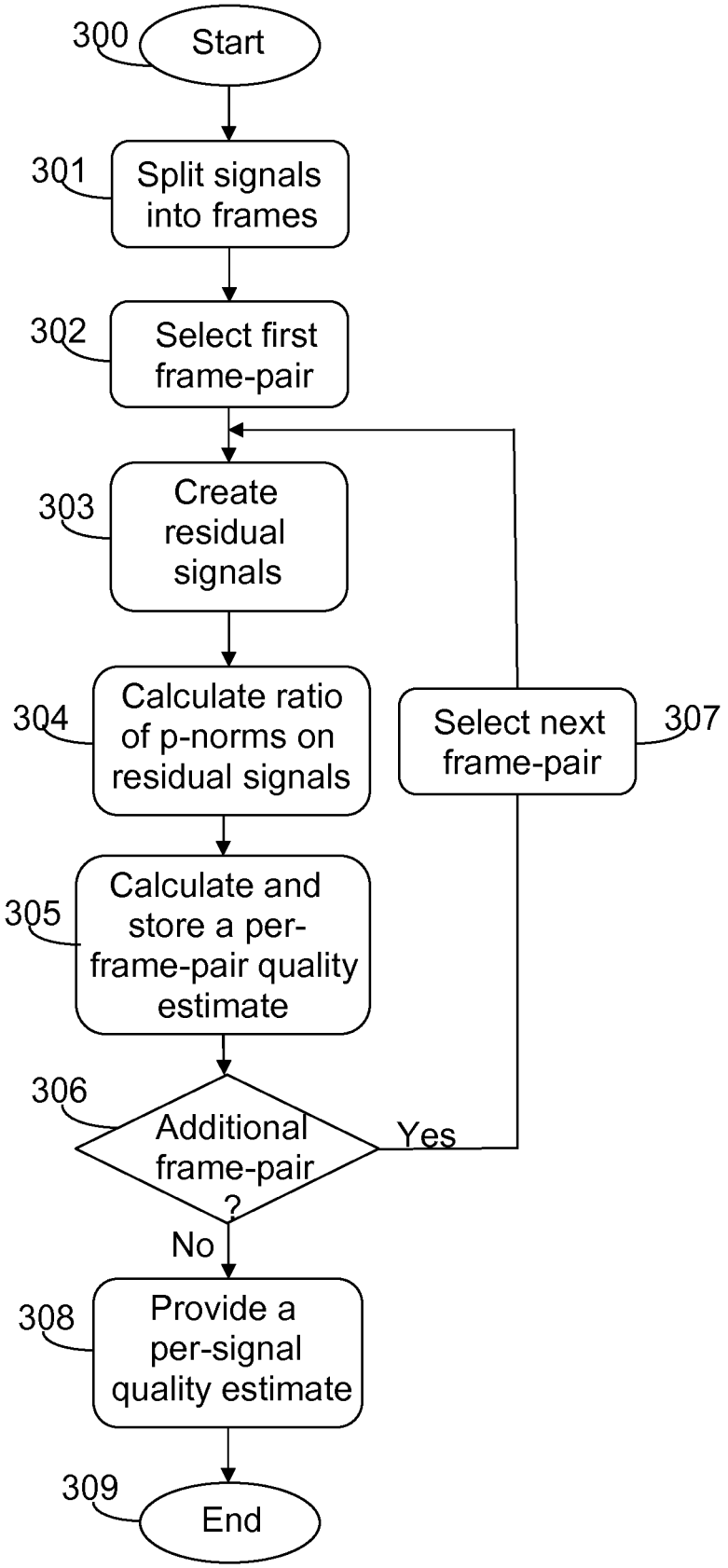
FIG. 3 is a flow chart illustrating a method for estimating a perceptual quality degradation of a speech or audio signal, according to one embodiment.

One way of executing such a signal processing will now be described in more detail, with reference to the flow chart of FIG. 3.

In a first step 301 of FIG. 3 an encoded audio or speech signal, from hereinafter referred to as the processed signal, that has been processed using any type of BWE or a noise fill scheme, and an associated reference signal are both split into frames. In a typical scenario the processed and the reference signal may e.g. be split into frames with a length of 32 ms, having an overlap of 50%.

In a next step 302, a first frame-pair, i.e. a first frame of the processed signal and the associated frame of the reference signal, are selected. In its simplest form, all frame-pairs may be chosen successively, i.e. all frame-pairs are chosen for further processing one after the other.

Alternatively, a predefined threshold may be used, such that only those frame-pairs for which the energy of the respective reference signal frame exceeds a predefined threshold will be selected for further processing.

According to another alternative, all frame-pairs are considered and only the frame-pairs for which the difference in energy between the reference signal having maximum energy and the energy of the reference signal frame of the respective frame pair is found to be below a predefined threshold, are selected.

In a subsequent step 303 separate residual signals for both the processed signal and the reference signal are created for the selected frame-pair. The residual signals may be created by using any type of conventional suitable residual processing. One commonly known way of creating the residual signals is to execute residual calculation through filtering the respective signal with a whitening filter in the time domain.

Alternatively the residual signals may instead be created through normalization of the respective signal in the frequency domain. Also this approach for creating a residual signal is known according to the prior art, and, for that reason both these alternative procedures for obtaining a residual signal will not be discussed in any further detail in this document.

A residual signal e(k) can be defined as:

$$e(k) = x(k) + \sum_{j=1}^{J} a(j)x(k-j) \tag{1}$$

where k is the sample index, x(k) is the input waveform, j is the delay, and a(j) represents the linear-predictive coefficients for the respective signal that are typically obtained through the well known Levinson-Durbin algorithm. J is the prediction order. From hereinafter the residual signal for the reference signal will be referred to as $e_r(k)$ while the corresponding residual signal for the processed signal will be referred to as $e_p(k)$.

A typical choice of J may be e.g. 10 for narrow band (NB) signals, 16 for Wide Band (WB) signals and 24 for Super Wide Band (SWB) signals. This step can also be considered as a step of creating the residual signals $e_r(k)$ and $e_p(k)$ by removing the respective spectral envelope.

In another step 304 a ratio of p-norms is calculated on the respective residual signals, i.e. one ratio of p-norms, $L_r$ is calculated for the reference signal, and another ratio of p-norms, $L_p$ is calculated for the processed signal of the selected frame-pair. $L_r(n)$ calculated for frame-pair n may be defined as:

$$L_r(n) = \frac{\left\{\frac{1}{K}\sum_{k=1}^{K}|e_r(k)|^S\right\}^{\frac{1}{S}}}{\left\{\frac{1}{K}\sum_{k=1}^{K}|e_r(k)|^Q\right\}^{\frac{1}{Q}}} \tag{2}$$

while $L_p(n)$ can be defined as:

$$L_P(n) = \frac{\left\{\frac{1}{K}\sum_{k=1}^{K}|e_p(k)|^S\right\}^{\frac{1}{S}}}{\left\{\frac{1}{K}\sum_{k=1}^{K}|e_p(k)|^Q\right\}^{\frac{1}{Q}}} \tag{3}$$

where S<Q and K is the total number of samples for frame-pair n. As a result from simulations, suitable values for S and Q may be e.g. 1 and 2, respectively.

The ratio of p-norms measures the amount of noise in the respective residual signal. If the residual signal is free of noise, the ratio of p-norms will have a value close to 0, while the p-norm value will approach 1 if the residual signal contains a significant amount of noise.

Once the respective ratios of p-norms have been calculated for the selected frame-pair, a quality estimate, D(n) is calculated and stored for frame-pair n, as indicated with another step 305. D(n), which from hereinafter is referred to as a per-frame-pair signal quality estimate, is defined as:

$$D(n) = \frac{L_r(n) - L_p(n)}{L_r(n) + L_p(n)} \tag{4}$$

In a step 306 it is determined if there are any additional frame-pairs for which a per-frame-pair signal quality estimate is to be determined. If this is the case, the subsequent frame-pair is selected, as indicated with a step 307 and the processing described with steps 303-305 is repeated also for this frame-pair.

Once a per-frame-pair signal quality estimate has been calculated for all relevant frame-pairs, all per-frame-pair signal quality estimates are aggregated to form a per-signal quality estimate, $D_{res}$, defined as:

$$D_{res} = \sqrt{\frac{1}{N}\sum_{n=1}^{N} D(n)^2} \tag{5}$$

where N is a parameter, which is indicating the relevant subset of the selected frame-pairs. This is indicated with a step 308.

Due to the process described above, the providing of the corresponding signal residuals, which also can be described as a process of separating the spectral envelope of the respective signals from the signal residual, the residual distortions will be made visible through the objective measure $D_{res}$.

In situations where it is known or suspected that processing of a BWE or a noise-fill scheme is the main cause of distortion of a processed signal the method described above may be executed in a stand-alone module from which $D_{res}$ can then be obtained as the output, to be used e.g. by an optimization device that is configured to adjust certain parameters in one or more network nodes, so as to compensate for the distortions.

If, on the other hand, there is a likeliness of also other additional distortions, a combination of different measures, each configured for assessing different dimensions of the perceived quality associated with a processed signal, may be used for providing a more general perceptual quality degradation estimate. A quality degradation estimate, here referred to as Q, may e.g. be derived as:

$$Q=w_1D_{res}+w_2D_2+w_3D_3+ \quad (6)$$

where $w_1$, $w_2$, $w_3$ . . . refer to weighting factors, each of which is associated with a respective measure, while $D_2$ and $D_3$ refers to additional per-signal quality estimates.

Such additional quality estimates may e.g. be directed to the level of additive background noise, quantization noise, noise introduced by the speech codec, and/or signal interruptions and gain variations.

An arrangement 400 for executing the method described with reference to FIG. 3, will now be described in more detail with reference to FIG. 4. The described arrangement 400 may typically be implemented in a network node of a communication network, and may be arranged such that the output can be used e.g. for analyzing and/or adjusting purposes. As indicated above, the arrangement may also be arranged in combination with functionality that is adapted to derive an estimate on the basis of other distortion sources. Such an arrangement may, however, be configured according to well known procedures, and, for that reason, such alternative solutions will not be described in any further detail in this document.

It is also to be understood that a typical arrangement 400 may also comprise additional functionality that is commonly used in the present context, such as e.g. receiving means and transmitting means for delivery of estimated results as input data to another functional entity. For simplicity reasons, such conventional functional means that are not necessary for the understanding of the specified way of obtaining quality estimates has, however, been omitted. According to FIG. 4, the arrangement 400 comprises functionality, here represented by an estimating unit 401, that is configured to split up a processed signal 203, and a reference signal 204, originating from a signal source 201, into frame-pairs, and to select the frame-pairs that fulfill the requirements for being further processed. As already mentioned above, all frame-pair may be successively selected, or a threshold may be used to select frame-pairs that exceed the threshold. Such comparison procedures are well known in the present technical field, and will therefore not be described in any further detail.

The estimating unit 401 is also configured to create the residual signals of the respective selected frame-pairs of input signals 203,204.

The estimating unit 401 is further configured to calculate ratios of p-norms on each frame-pair of the residual signals obtained in the previous step, and also a quality estimate for each frame-pair, on the basis of the calculated ratios of p-norms obtained for each respective frame-pair.

Figure 4:
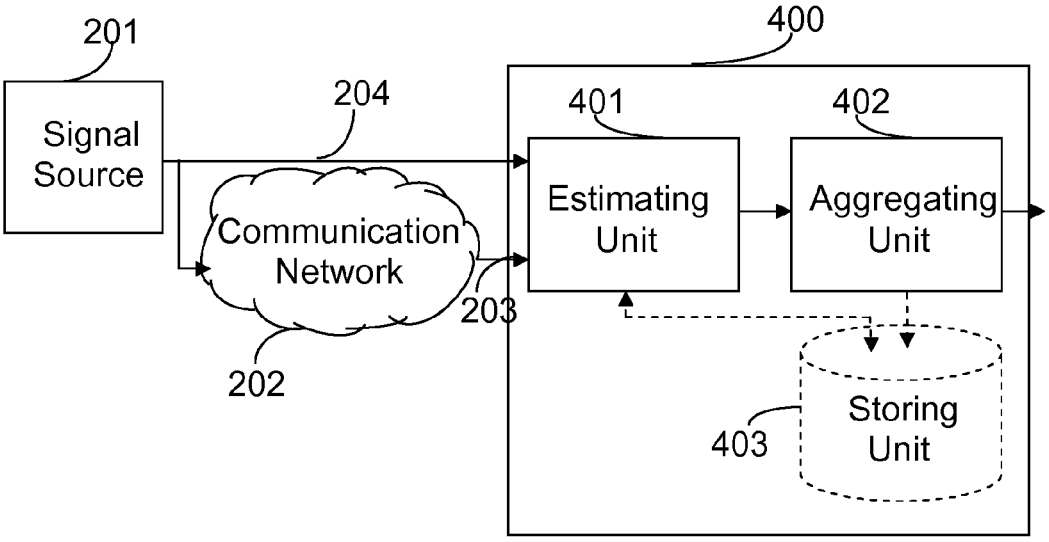
FIG. 4 is an exemplified architecture of an arrangement suitable for executing the method described with reference to FIG. 3.

The arrangement 400 according to the exemplified architecture of FIG. 4 also comprises an aggregating unit 402 that is configured to aggregate the per-frame estimates to form a per-signal quality estimate that can be seen as an estimate of the perceptual quality degradation, caused by use of BWE or noise-fill schemes in the encoder at the signal source 201. The quality estimate obtained by the aggregating unit 402 may be used by any interconnected device (not shown) on the fly. Alternatively, arrangement 400 may comprise a storing unit 403, for storing the per-frame estimates and/or the per-signal estimates, for later retrieval.

Quality estimates obtained according to the method described above may be used both by manufacturers and network operators for the purpose of configuring or re-configuring the network in an optimal way. Alternatively, the results from the suggested quality estimations may be used e.g. for automatic detection, analysis of failed network nodes, and/or for collecting statistics on the performance of different network types, used both by manufacturer and network operators.

Results from simulations performed with conventional speech and audio quality assessment schemes show low prediction accuracy in a scenario where BWE and noise-fill artifacts have been considered.

In the Multi Stimulus test with Hidden reference and Anchor (MUSHRA) which is a known listening test, listeners quantify the effects of six different types of BWE artifacts. More details on this test can be retrieved from "ITU-R Rec. BS.1534-1, Method for the subjective assessment of intermediate quality level of coding systems, 2005"

The result of such a test is presented in the following table 1.

TABLE 1

| | Condition | | | | | | |
|---|---|---|---|---|---|---|---|
| Measure | I | II | III | IV | V | VI | |
| MUSHRA | 90.57 | 81.73 | 48.36 | 85.82 | 40.08 | 36.47 | R |
| SNR (dB) | 24.40 | 27.72 | 21.01 | 15.72 | 17.57 | 17.59 | 0.47 |
| SD (dB) | 0.508 | 0.951 | 2.220 | 1.043 | 1.564 | 0.879 | 0.56 |
| PEAQx (−1) | 0.508 | 0.951 | 2.220 | 1.043 | 1.564 | 0.879 | 0.57 |
| Dres x 10 | 0.156 | 0.162 | 0.362 | 0.230 | 0.499 | 0.396 | 0.93 |

Table 1 shows the results from a comparison of the proposed metric $D_{res}$ against three measures of objective speech quality obtained by known estimating methods, namely a Signal-to-noise ratio (SNR) measure, a Spectral Distortion (SD) measure and a Perceptual evaluation of audio quality (PEAQ) measure and an evaluation in terms of per-condition correlation coefficient R between subjective and objective values. The sign of the correlation has been removed, since SD and $D_{res}$ are distortions, and, as such, negatively correlated with quality, while SNR and PEAQ are positive correlated with the subjective quality.

According to the MUSHRA listening test the artifacts have been introduced in the MDCT domain, as is typically done in the speech/audio coding. The manipulations have all been performed in the upper half of the frequency bands, in this case in the 7-14 kHz band, where distortions have been introduced in the following three different perceptual dimensions:

1. Change in spectral flatness, represented by three different conditions, namely I, II and III below, where the original HF residual is compressed and expanded to different degrees.

Condition I refers to a compression that increases flatness by 13.3%, while condition II refers to an expansion that decreases flatness by 13.8%, and condition III refers to an expansion that decreases flatness by 40.2%.

2. Change in peaks position, achieved by circular shift in original HF residual, defined as Condition IV, where changes in peaks position by circular shift.

3. Change in periodicity, achieved by adding a pulse train to the original HF band, where the pulse train simulates LF pitch harmonics that might occur when LF band is flipped or translated at the position of HF band. This final perceptual dimension is represented by condition V, defined as increased periodicity that is obtained by adding a 200 Hz pulse train, and by condition VI, defined as increased periodicity by adding a 100 Hz pulse train.

It is obvious that the method which is the focus of this document show a result which is considerably more reliable than the results of the alternative methods used in the test.

Trough out this document, the terms used for expressing functional units, such as e.g. "estimating unit" and "aggregating unit", should be interpreted and understood in a broad sense to represent any type of units which have been configured to process and handle signals according to the principles described in this document.

In addition, while the invention has been described with reference to specific exemplary embodiments, the description is generally only intended to illustrate the inventive concept and should not be taken as limiting the scope of the invention, which is defined by the appended claims.

ABBREVIATIONS

BWE Band Width Extension
HF High-Frequency
LF Low-Frequency
MDCT Modified Discrete Cosine Transform
MUSHRA Multi Stimulus test with Hidden Reference and Anchor
PESQ Perceptual evaluation of speech quality
PEAQ Perceptual Evaluation of Audio Quality
SBR Spectral Band Replication
SD Spectral Distorsion
SNR Signal-to-noise ratio
WGN White Gaussian Noise

The invention claimed is:

1. An objective quality assessment method for estimating a perceptual quality degradation of a processed signal, the method comprising the following steps to be executed on the processed signal and a reference signal:

a) splitting the reference signal and the processed signal into associated frame-pairs;
b) selecting a first frame-pair;
c) creating a reference residual signal and a processed residual signal for the selected frame-pair;
d) calculating separate ratios of p-norms on both residual signals for the selected frame-pair;
e) calculating and storing a per-frame quality estimate based on the ratios of p-norms for the selected frame-pair;
f) iteratively selecting additional frame-pairs, and repeating steps c) to e) for each additional frame-pair; and
g) aggregating the calculated per-frame-pair quality estimates to provide an objective per-signal quality estimate that is proportional to the perceptual quality degradation of the processed signal.

2. The quality assessment method of claim 1, wherein the processed signal has been processed by a bandwidth extension scheme or noise-fill scheme.

3. The quality assessment method of claim 1, further comprising:

h) repeatedly providing and storing objective per-signal quality estimates; and
i) iteratively adjusting at least one parameter of a network node that is used for distribution of the processed signal on the basis of at least one of the objective per-signal quality estimates.

4. The quality assessment method of claim 1, wherein step f) comprises selecting a subsequent frame-pair.

5. The quality assessment method of claim 1, wherein the step of iteratively selecting additional frame-pairs comprises selecting subsequent frame-pairs for which the energy of the respective reference signal frame exceeds a predefined threshold.

6. The quality assessment method of claim 1, wherein the step of iteratively selecting additional frame-pairs comprises selecting subsequent frame-pairs for which the difference in energy between the reference signal having maximum energy and the energy of the reference signal frame of the respective frame-pair is below a predefined threshold.

7. The quality assessment method of claim 1, wherein the step of calculating separate ratios of p-norms comprises calculating a ratio of p-norms, $L_r(n)$, for the reference signal, and a ratio of p-norms, $L_p(n)$, for the processed signal for frame-pair n, wherein:

$$L_r(n) = \frac{\left\{\frac{1}{K}\sum_{k=1}^{K}|e_r(k)|^S\right\}^{\frac{1}{S}}}{\left\{\frac{1}{K}\sum_{k=1}^{K}|e_r(k)|^Q\right\}^{\frac{1}{Q}}}$$

and $$L_P(n) = \frac{\left\{\frac{1}{K}\sum_{k=1}^{K}|e_p(k)|^S\right\}^{\frac{1}{S}}}{\left\{\frac{1}{K}\sum_{k=1}^{K}|e_p(k)|^Q\right\}^{\frac{1}{Q}}}$$

where $e_r(k)$ is the residual reference signal for sample k, $e_p(k)$ is the processed residual signal for sample k, K is the total number of samples of frame-pair n, and S and Q are optimization parameters with S being less than Q.

8. The quality assessment method of claim 7, wherein the per-frame-pair quality estimate, D(n), for frame n is defined as:

$$D(n) = \frac{L_r(n) - L_p(n)}{L_r(n) + L_p(n)}.$$

9. The quality assessment method of claim 1, wherein the per-signal quality estimate, $D_{res}$, is defined as:

$$D_{res} = \sqrt{\frac{1}{N}\sum_{n=1}^{N} D(n)^2}$$

where N is the total number of selected frame-pairs.

10. A network node for providing an estimate of a perceptual quality degradation of a processed signal, by further processing the processed signal and an associated reference signal, the network node comprising:

a receiver configured to receive the processed signal from a communications network and the reference signal from a signal source;

an estimating unit connected to the receiver and configured to:

split the reference signal and the processed signal into associated frame-pairs; iteratively select frame-pairs for successive further processing; and for each selected frame-pair, to:

create a reference residual signal and a processed residual signal; calculate separate ratios of p-norms on both residual signals for the selected frame-pair; and calculate a per-frame quality estimate on the basis of the ratios of p-norms for the selected frame-pair;

a tangible storage unit connected to the estimating unit and configured to store the calculated per-flame quality estimates; and an aggregation unit connected to the estimating unit and to the storage unit, and configured to provide an objective per-signal quality estimate that is proportional to the perceptual quality degradation of the processed signal, by aggregating the calculated per-flame-pair quality estimates.

11. The network node of claim 10, wherein the estimating unit is further configured to repeatedly provide objective per-signal quality estimates to a receiving device.

12. The network node of claim 10, wherein the estimating unit is further configured to select frame-pairs by selecting each subsequent frame-pair.

13. The network node of claim 10, wherein the estimating unit is further configured to select frame-pairs by selecting subsequent frame-pairs for which the energy of the respective reference signal frame exceeds a predefined threshold.

14. The network node of claim 10, wherein the estimating unit is further configured to select frame-pairs by selecting subsequent frame-pairs for which the difference in energy between the reference signal having maximum energy and the energy of the reference signal frame of the respective frame-pair is below a predefined threshold.

15. The network node of claim 10, wherein the aggregation unit is configured to provide the objective per-signal quality estimate by combining the aggregated, calculated per-frame-pair quality estimates with at least one additional per-signal quality estimate.

16. The network node of claim 10, wherein the estimating unit is further configured to create the residual signals by filtering the processed and reference signals with a whitening filter in the time-domain.

17. The network node of claim 10, wherein the estimating unit is further configured to create the residual signals by normalizing the processed and reference signals in the frequency-domain.

18. A perceptual quality degradation estimation system, comprising:

a receiver configured to receive a processed signal from a communications network and a reference signal from a signal source;

an estimating unit connected to the receiver and configured to:

split the reference signal and the processed signal into associated frame-pairs;

iteratively select frame-pairs for successive further processing; and for each selected frame-pair to:

create a reference residual signal and a processed residual signal; calculate separate ratios of p-norms on both residual signals for the selected frame-pair; and calculate a per-frame quality estimate on the basis of the ratios of p-norms for the selected frame-pair;

a tangible storage unit connected to the estimating unit and configured to store the calculated per-flame quality estimates;

an aggregation unit connected to the estimating unit and to the storage unit, and configured to provide an objective per-signal quality estimate that is proportional to the perceptual quality degradation of the processed signal by aggregating the calculated per-flame-pair quality estimates, wherein the estimating unit, storage unit and aggregation unit correspond to a network node; and a network optimizing unit connected to the aggregation unit and configured to execute configurations, re-configurations, or both of the network node on the basis of an objective per-signal quality estimate received from the aggregation unit.

19. A perceptual quality degradation estimation system, comprising:

a receiver configured to receive a processed signal from a communications network and a reference signal from a signal source;

an estimating unit connected to the receiver and configured to:

split the reference signal and the processed signal into associated frame-pairs;

iteratively select frame-pairs for successive further processing; and for each selected frame-pair to:

create a reference residual signal and a processed residual signal; calculate separate ratios of p-norms on both residual signals for the selected frame-pair; and calculate a per-frame quality estimate on the basis of the ratios of p-norms for the selected frame-pair;

a tangible storage unit connected to the estimating unit and configured to store the calculated per-flame quality estimates;

an aggregation unit connected to the estimating unit and to the storage unit, and configured to provide an objective per-signal quality estimate that is proportional to the perceptual quality degradation of the processed signal by aggregating the calculated per-flame-pair quality estimates, wherein the estimating unit, storage unit and aggregation unit correspond to a network node; and a network optimizing unit connected to the aggregation unit and configured to execute configurations, re-configurations, or both of the network node on the basis of an objective per-signal quality estimate received from the aggregation unit.

* * * * *

UNITED STATES PATENT AND TRADEMARK OFFICE

CERTIFICATE OF CORRECTION

PATENT NO. : 8,949,114 B2
APPLICATION NO. : 13/321937
DATED : February 3, 2015
INVENTOR(S) : Grancharov et al.

It is certified that error appears in the above-identified patent and that said Letters Patent is hereby corrected as shown below:

On the title page item (56), under "OTHER PUBLICATIONS", in Column 2, Line 1, delete "Ekman, L et al.," and insert --Ekman, L. et al.,-- therefor.

In the specification

In Column 3, Line 43, delete "S and" and insert --S and Q-- therefor.

In Column 7, Line 11, delete "$Q=w_1D_{res}+w_2D_2+w_3D_3+$" and insert --$Q=w_1D_{res}+w_2D_2+w_3D_3+..$-- therefor.

Signed and Sealed this
Fifteenth Day of December, 2015

Michelle K. Lee

Michelle K. Lee
*Director of the United States Patent and Trademark Office*